United States Patent [19]

Stahl et al.

[11] Patent Number: 4,694,907

[45] Date of Patent: Sep. 22, 1987

[54] THERMALLY-ENHANCED OIL RECOVERY METHOD AND APPARATUS

[75] Inventors: Charles R. Stahl, Scotia, N.Y.; Michael A. Gibson; Christian W. Knudsen, both of Houston, Tex.

[73] Assignee: Carbotek, Inc., Houston, Tex.

[21] Appl. No.: 832,267

[22] Filed: Feb. 21, 1986

[51] Int. Cl.[4] ..... E21B 36/04; E21B 43/24

[52] U.S. Cl. ..... 166/303; 166/60; 166/65.1

[58] Field of Search ..... 166/59, 60, 61, 250, 166/303, 265, 266, 267, 65.1; 299/6

[56] References Cited

U.S. PATENT DOCUMENTS

| | | | |
|---|---|---|---|
| 4,157,847 | 6/1979 | Williams et al. | 299/6 |
| 4,185,691 | 1/1980 | Tubin et al. | 166/250 |
| 4,499,946 | 2/1985 | Martin et al. | 166/267 X |
| 4,546,829 | 10/1985 | Martin et al. | 166/267 |

OTHER PUBLICATIONS

"Coates Model BAH High Voltage Electrode Steam Boilers", Bulletin 410, Oct. 1979, 4 pages.

*Primary Examiner*—Stephen J. Novosad
*Attorney, Agent, or Firm*—Neal J. Mosely

[57] ABSTRACT

A thermally-enhanced oil recovery method and apparatus for exploiting deep well reservoirs utilizes electric downhole steam generators to provide supplemental heat to generate high quality steam from hot pressurized water which is heated at the surface. A downhole electric heater placed within a well bore for local heating of the pressurized liquid water into steam is powered by electricity from the above-ground gas turbine-driven electric generators fueled by any clean fuel such as natural gas, distillate or some crude oils, or may come from the field being stimulated. Heat recovered from the turbine exhaust is used to provide the hot pressurized water. Electrical power may be cogenerated and sold to an electric utility to provide immediate cash flow and improved economics. During the cogeneration period (no electrical power to some or all of the downhole units), the oil field can continue to be stimulated by injecting hot pressurized water, which will flash into lower quality steam at reservoir conditions. The heater includes electrical heating elements supplied with three-phase alternating current or direct current. The injection fluid flows through the heater elements to generate high quality steam to exit at the bottom of the heater assembly into the reservoir. The injection tube is closed at the bottom and has radial orifices for expanding the injection fluid to reservoir pressure.

24 Claims, 9 Drawing Figures

THERMALLY-ENHANCED OIL RECOVERY METHOD AND APPARATUS

BACKGROUND OF THE INVENTION

1. Field of The Invention

This invention realtes generally to thermally-enhanced oil recovery methods, and more particularly to a method and apparatus for thermally-enhanced oil recovery of deep well reservoirs utilizing electric downhole steam generators to provide supplemental heat to a flow of high pressure hot water to generate high quality steam.

2. Background Information

Generally lowering crude oil prices make it economically difficult to justify development of new oil fields. Most of the new oil field developments are likely to be in remote or off-shore areas, with high exploration and field operating costs. Thermally-enhanced oil recovery methods that are applied to already discovered domestic heavy oil fields have an in-place infrastructure and a near-by market. Also, when crude oil prices are stabilized, the efficiency of the thermal recovery process for heavy oil production keeps the latter competitive at lower prices.

The economics of thermally-enhanced oil recovery can also be significantly improved when cogeneration of electricity is considered. It is believed that this will be particularly advantageous in deep reservoir regions such as the Texas and Mississippi areas as well as in California with the established infrastructure, the need to continue oil production and ready markets for both crude oil and electric power.

California has a large number of suitable deep reservoirs, but it also has many shallow reservoirs, which have not yet been fully exploited. In Texas and Mississippi, however, 90% of the suitable reservoirs are at dephths below 2500 feet. In order for these states to keep their rate of oil production, they must depend increasingly upon enhanced oil recovery. Since thermally-enhanced oil recovery or steamflooding is one of the most efficient, advanced, and economical of enhanced oil recovery methods, this process is one that will be used more often.

Because of the heat loss in conventional bare steam injection pipes, it is difficult to supply steam efficiently to reservoirs deeper than 2500 feet. The steam pipe is relatively large when compared to the typical 7-inch well bore dimension. The steam pipes must be installed in sections and therefore, space must be allowed for the screw joints between sections. The pipes must also be large enough to supply the steam with a relatively low pressure drop. For example, at reservoir depth of 2500 feet, the reservoir pressure is over 1000 psia. Since the steam is a low density fluid, there is little help from its hydrostatic head (40 psi). Insulated piping (double-walled) is often used, but this increases the space problem.

Other methods of transporting the heat downhole have been suggested which have the combustion occur at the reservoir face. Such downhole burners have been tried experimentally with limited success. Other systems which transport fuel, feed water, and oxidizer (usually air) downhole where combustion occurs have been suggested also. One system uses the hot gases to boil water with a heat exchanger so that the combustion can occur at nearly atmospheric pressure. This system cannot exhaust the cooled exhaust gas into the reservoir because its pressure is too low. Therefore, it must be transported back up the well bore to the surface. Any gaseous pollution products must then be handled at each injection well.

Another system carries out the combustion at a pressure greater than the reservoir pressure which permits the combustion products to be discharged into the reservoir. This system requires the compression of both the fuel and oxidizer as well as solving the technical problem of carrying out the combustion at very high pressures. The control of the combustion and water boiling processes in restricted dimensions at a distance up to a mile in the earth poses severe technical problems. While these technical problems may be solved, there is concern about the ability to operate these devices practically in an oil field environment.

3. Brief Description of the Prior Art

There are several patents which disclose various systems of thermally-enhanced oil recovery utilizing electrical steam generators for heating injection fluids or production fluids.

Stegmeier, U.S. Pat. No. 2,932,352 discloses multiple heating elements circumferentially placed about an axially extending conduit, the elements being divided into groups of three with each group being supplied with a single phase of three-phase alternating current and the elements of each group being electrically connected at the bottom. The heater of the Stegemeier patent is used to heat fluids residing in a reservoir.

Curson, U.S. Pat. No. 2,754,912 discloses another system having multiple heating elements circumferentially placed about an axially extending conduit, the elements being divided into groups of three with each group being supplied with a single phase of three-phase alternating current and the elements of each group being electrically connected at the bottom. The heater of Curson is used to heat fluids being produced through an oil stem.

Schlinger, U.S. Pat. No. 4,007,786 discloses a secondary recovery process using steam as a stimulation fluid, the steam being generated by sensible heat recovered from a gas turbine which optionally may be used to drive an electric generator for providing electrical energy.

Tubin et al, U.S. Pat. No. 4,127,169 discloses a secondary recovery process using an electrically-powered downhole steam generator providing thermal stimulation of deep reservoirs. The system does not use surface steam lines or a boiler. Cold water is pumped down the tubing string to be converted to steam.

Gill, U.S. Pat. No. 3,614,986 discloses a recovery process including flowing electrical current through an injection turbine used to convey heated fluids to a mineral bearing formation and thereby producing sufficient heat in the turbine to prevent heat loss from the injection fluids while they move through the turbine.

The present method for exploiting deep-well reservoirs utilizing electric downhole steam generators is distinguished over the prior art by its provision of a thermally efficient system for adding heat to high pressure hot water. The downhole steam generators are powered by electricity from above-ground turbine-driven electric generators fueled by any clean fuel, possibly from the production field itself. The downhole steam generators include multiple heating elements circumferentially disposed around an axial, insulated, small-diameter injection tube, the heating elements being divided into three groups with each group being supplied with a separate phase in a three-phase "Y" alternating current electrical system. The injection tube is closed at the bottom and contains radial orifices so that the injection fluid (pressurized hot water) flows between the heating elements to generate high quality steam. This steam then exits the heater assembly and flows into the oil reservoir that is being thermally stimulated. Heat recovered from the gas turbine exhaust is used to provide pressurized hot injection water, and, when desired, electrical power may be sold to an electric utility to provide an immediate cash flow and improved economics.

SUMMARY OF THE INVENTION

It is therefore an object of the present invention to provide a thermally-enhanced oil recovery method for efficient and economical steamflooding for suitable oil reservoirs and in particular for those that lie at depths below 2000 feet.

It is another object of this invention to provide a thermally-enhanced oil recovery method which minimizes thermal losses to the well environment by supplying the heat through a continuous small-diameter fully insulated tube and by utilizing efficient electrical transmission.

Another object of this invention is to provide a thermally-enhanced oil recovery method wherein the choice of a specific operating pressure will allow the ratio of thermal exhaust and electrical energy produced by standard industrial gas turbines to match the needs of the system. This includes the ability to raise pressure during the period when electricity is sold to increase the energy contents of the hot water being injected.

Another object of this invention is to provide a thermally-enhanced oil recovery method which permits cogeneration sale or use of electric power while still providing reduced thermal energy to the oil field thereby optimizing the economic return.

Another object of this invention is to provide a thermally-enhanced oil recovery method which can effectively reduce pollution by utilizing a conventional gas turbine when fuelled by natural gas, distillate, or sufficiently clean crude oils.

Another object of this invention is to provide a thermally-enhanced oil recovery method which has the ability to operate with saturated water, low-quality steam, or with high-quality steam to match the reservoir characteristic and minimize channelling. The large density difference between the high-quality steam and water permits a wide range of injectant density characteristics so that override effects may be mitigated.

Another object of this invention is to provide a thermally-enhanced oil recovery method and apparatus which is commercially accepted, simple in construction and operation, economical to manufacture, and rugged and durable in use.

Another object of the invention is to provide high-pressure hot water for injecting thermal energy into a reservoir where, because of the comparatively high density of the hot water column, the hydrostatic heat compensates for the pressure-drop loss in the injection tube or provides the higher pressure necessary for very deep wells. In either case, the pressure of the above-ground equipment is minimized.

A further object of this invention is to provide the flexibility to develop advantageous economics for each period of operations. The amount and type of electrical sales can be varied, together with the oil production. This ability to decouple the thermal energy (oil production) from electrical sales provides a means of continuously optimizing the return from an enhanced oil recovery project.

A still further object of this invention is to provide electrical energy for sale (cogeneration) or other use on a demand basis. This permits the system to supply high value peaking power as it is needed. Peaking power is needed only a small percentage of the time (10–20%), as the daily, weekly or yearly peaking power demands occur.

A reliable source of cogenerated peaking power from this invention would eliminate the need for the utility to install and operate the generating facilities that are needed only a small part of the year. Peaking power, therefore, has a high value based on the cogeneration guidelines of avoided cost. The sale of peaking power maximizes the return from electrical sales while having a small effect on oil production.

Other objects of the invention will become apparent from time to time throughout the specification and claims as hereinafter related.

The above-noted objects and other objects of the invention are accomplished by the present thermally-enhanced oil recovery method for exploiting deep well reservoirs utilizing electric downhole steam generators to provide supplemental heat for high pressure hot water or steam to counteract heat losses occuring in a deep well. The downhole steam generators are powered by electricity from above-ground turbine driven electric generators fueled by clean fuels, possibly natural gas from the field. The downhole steam generators include multiple heating elements circumferentially disposed about an axially extending insulated small-diameter injection tube, the heating elements being divided into three groups with each group being supplied with a separate phase of a three-phase "Y" alternating current electrical system. The injection tube is closed at the bottom and contains radial orifices so that injection fluid (pressurized hot water) flows between the heater elements and generates high quality steam. This steam then flows into the reservoir that is being treated. Heat recovered from the system is used to provide pressurized hot injection water, and electrical power may be sold to an electric utility to provide an immediate cash flow.

The present system provides some of the heat by transporting part of it downhole as hot water with the remainder delivered electrically to the reservoir face. By injecting saturated water at high pressure, approximately 65% of the heat is supplied in this fashion. The energy contained in the hot water increases as the pressure increases. For example, a pressure increase from 1000 psia to 2000 psia increases the energy that a pound of saturated water contains by almost 25%. The density of the saturated water at 2000 psia is 7.5 times greater than steam. This higher density of hot water provides two major advantages. The first is the ability to use a smaller pipe to conduct the heat down into the well. The second is the large hydrostatic head that exists because of the high density of the liquid water. At 2500 feet, the hydrostatic head is 675 psi for saturated water at 2000 psia operating pressure.

Since the present invention uses an insulated small-diameter continuous tube of constant diameter (such as 1-inch diameter), the pressure drop of the water flowing down the tube is proportional to depth. The pressure drop then provides a linear gradient from the top (highest pressure) to the bottom (lowest pressure). If the total pressure drop were equal to the hydrostatic head (675 psi in our example), then the two pressures would cancel each other at all points down the tube. The tube pressure would then be constant along its entire length and be equal to the initial pressure applied at the well head. When, for other reasons, the operating pressure is higher than the reservoir pressure, an orifice can be used to reduce the pressure at the reservoir face.

In order to supply the remaining heat downhole, electrical power is transmitted to the reservoir face. This method of transmission is very efficient compared to thermal transmission. Electric cables, each permanently connected to its resistance heater, supply the remaining 35% of the heat. While the electric power might be supplied by a utility for this application, a markedly more efficient means is to use an on-site gas turbine to supply both the pressurized hot water from the turbine exhaust and the electricity from an electrical generator driven by the turbine. As it happens, gas turbines have a ratio of heat to electricity that matches the requirements of the proposed system using a reasonable operating pressure. The total energy (fuel) input to the proposed system using a gas turbine is the same as the conventional boiler steamflooding system with both delivering about the same amount of heat to the well head. However, the much smaller downhole heat loss (factor of 8) makes the proposed system more economical for the deeper reservoirs.

Another dimension can be achieved by supplying part or all of the electric power for other uses (cogeneration) while still supplying the thermal heat from the gas turbine exhaust. Cogeneration provides major economic advantages, since the system has the flexibility to supply the power on a demand basis. For example, at 2500 feet, with peaking power rates and with 25% cogeneration, the process cost per barrel of oil is half that of the conventional system.

DESCRIPTION OF THE PREFERRED (AC) EMBODIMENT

Figure 1:
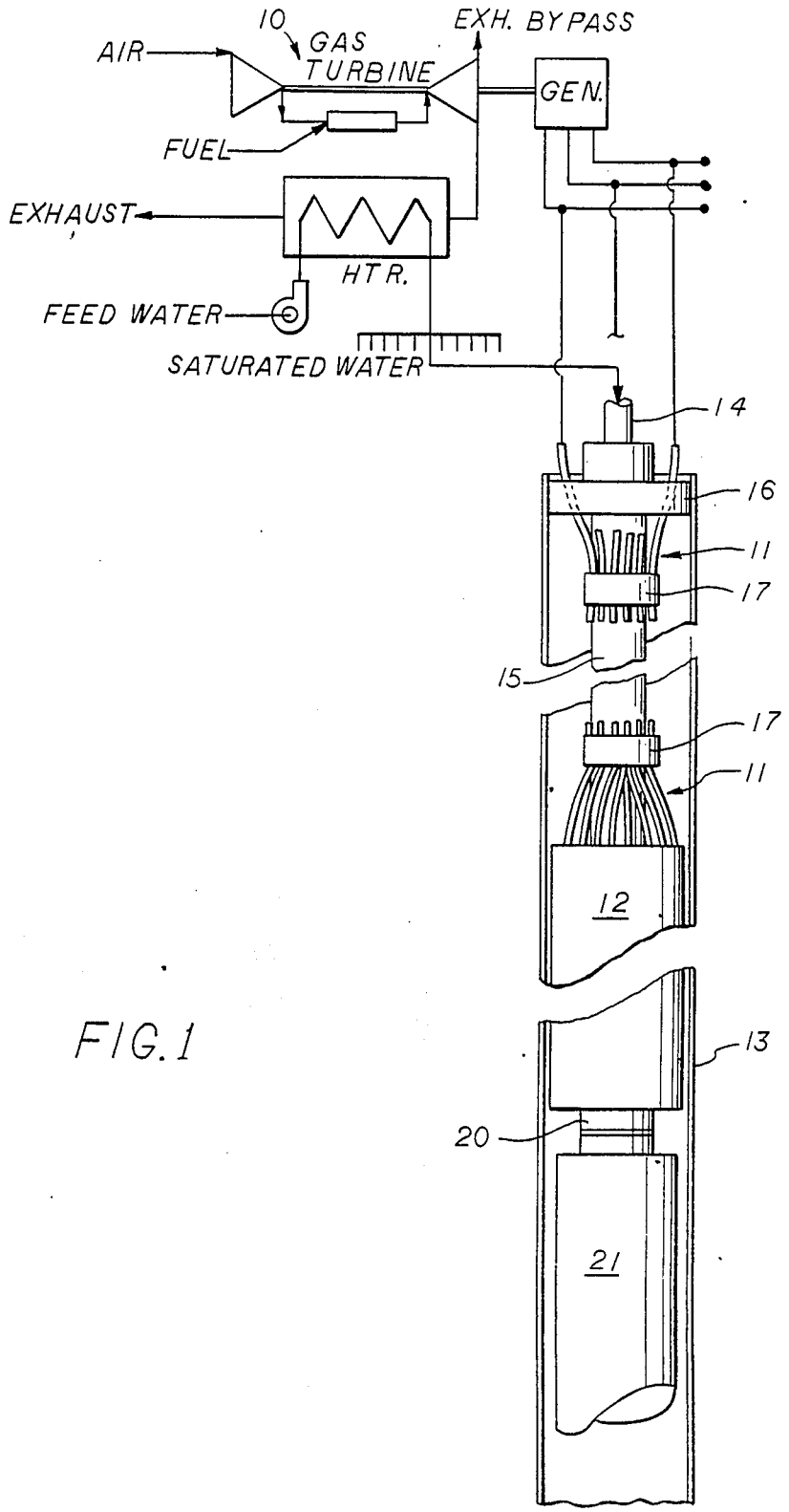
FIG. 1 is a schematic illustration of the components of a preferred thermally-enhanced oil recovery system using alternating current.

The thermally-enhanced oil recovery system in accordance with the present invention provides a method for exploiting deep well reservoirs by utilizing electric downhole steam generators to provide supplemental heat for high pressure hot water minimize losses occurring in a deep well. There is shown schematically in FIG. 1, a preferred system utilizing alternating current. Above-ground, turbine-driven electric generators 10 supply electrical power through electrical cables 11 to generate steam within a heater assembly 12 disposed in the well string casing 13 below ground to heat injection fluids. The turbine-driven electric generators 10 are fueled by clean fuel, possibly from the field being stimulated.

The downhole heater assembly 12 (described in greater detail hereinafter) contains a series of U-shaped electric heating elements circumferentially disposed about a continuous axially extending injection tube 14. The injection tube 14 preferably has no mechanical joints. The upper end of a hollow support tube 15 is connected to the upper end of the well casing 13 by a flange 16 and the support tube extends downward centrally within the casing. The support tube 15 is formed of the structural unit that provides maximum support of the downhole string, surrounds and guides the injection tube 14 above the heater assembly 12 and supports and guides the electrical cables 11.

The electrical cables 11 are also preferably continuous without end connectors. Since each of the cables 11 is permanently attached to a U-shaped heater, each heater can be fused and controlled separately. The cables 11 may be reeled and attached by conventional means such as clamps 17 to the outside of the support tube 15. The cables 11 can support their own weight and the clamps 17 may be spaced intermittently along the support tube length provide spacing between the support tube 15 and the well string casing 13 to protect cables 11.

The injection tube 14 is closed at the bottom and contains radial orifices 19 so that injection fluid (pressurized hot water) flows between the heater elements (described hereinafter) and is vaporized. This steam then exists through the bottom of the heater assembly 12 and flows downward into the reservoir being stimulated. The cylindrical outer housing surrounding the heater assembly 12 ducts the steam flow down through a coupling 20 where conventional high temperature packers and expansion joints 21 may be attached.

A three-phase, grounded neutral "Y" electrical system is used with one end of each of the U-shaped heater elements being common and the neutral of the system. The neutral is grounded and carries only the unbalanced current flow. Alternatively, a direct current DC conversion electrical system (FIGS. 6–9) may be used as described hereinafter. With a perfectly balanced 3-phase "Y" system, no current would flow in the neutral. However, practically, there is always some imbalance, and with failed heaters, there would be significant neutral current flow.

Referring now to FIGS. 2, 3, 4, and 5, the downhole heater assembly 12 comprises a series of U-shaped electric heating elements 30 circumferentially disposed about the axially extending injection tube 14. The injection tube 14 is preferably made of small-diameter titanium alloy tubing and is covered with thermal insulation 31 and an outer sheat 32. Because of its small-diameter and the flexibility of titanium, the tube has enough flexibility to be practically assembled as a single unit. The injection tube 14 is installed in the support tube 15 after the support tube 15 has been inserted into the well bore in lengths that are screwed together.

The flexibility for a steel injection tube 14 is less than, for a titanium tube, which has higher strength and half the Young's Modulus. As a result, the steel tube may require lengths of injection tubes to be welded in the field. However, the titanium injection tube 14 can be assembled with insulation and sheath in the factory and then reeled and shipped to the use site. In either case, the injection tubes are to be installed, withdrawn and reinserted in one piece in the field.

Figure 2:
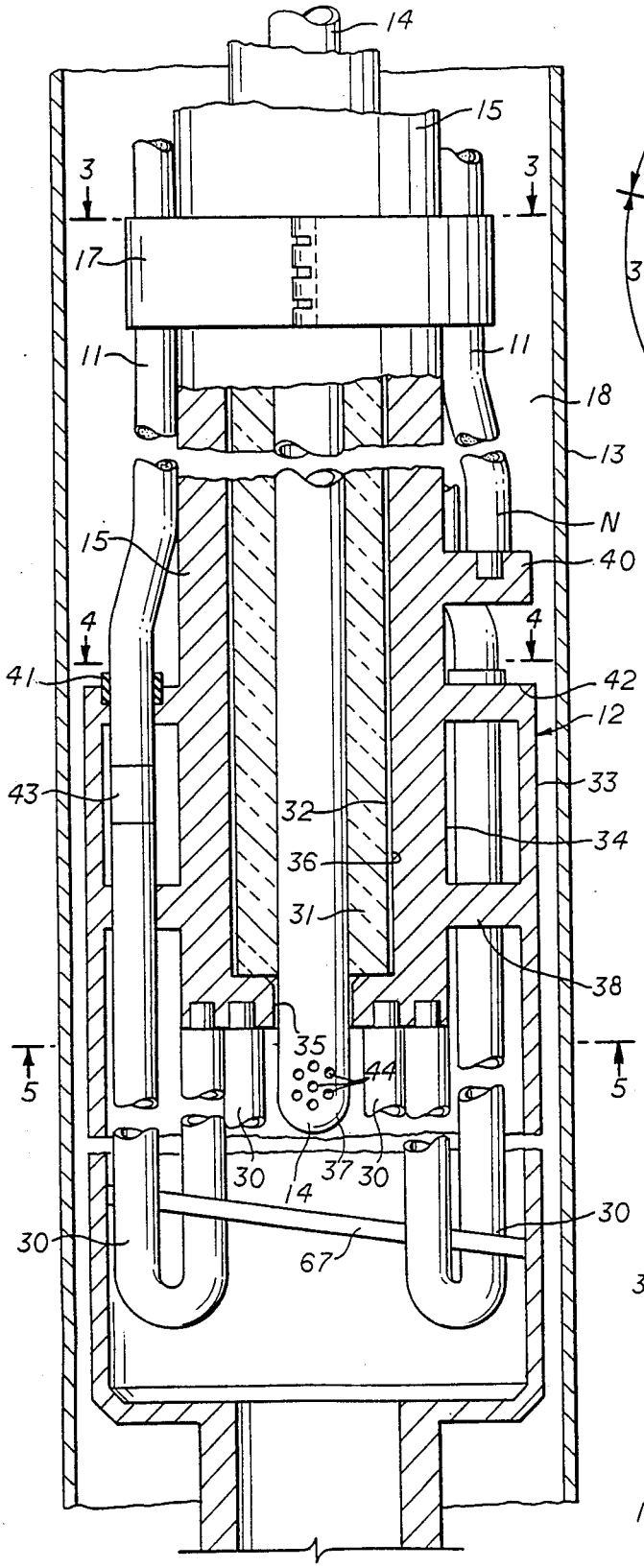
FIG. 2 is a longitudinal cross section of the heater assembly showing the electrical cable and heater regions and the support tube and injection tube regions of the alternating current embodiment.

As shown in FIG. 2, the lower end of the support tube 15 provides a transition that transfers the support of the well string from the support tube 15 to a cylindrical outer side wall portion 33 concentric with, and spaced radially outward from the cylindrical interior portion 34. The exterior diameter of the outer side wall 33 is smaller than the interior diameter of the well casing 13 to form an annulus between them. The support tube interior portion 34 is provided with a bore 35 at its lower end which is smaller in diameter than the central bore 36. The injection tube 14 has a bare portion 37 which extends downwardly through the bore 35 to terminate in the heater array. The transition between the electrical cable and heater regions and the support tube and injection tube regions occurs within the lower cylindrical portion of the support tube 15. The cylindrical outer wall 33 of the support tube 15 below the heater region is reduced in diameter and provided with a connection 20 which allows the attachment of conventional packers and expansion joints 21 that will direct the steam to the reservoir face (FIG. 1).

Figure 3:
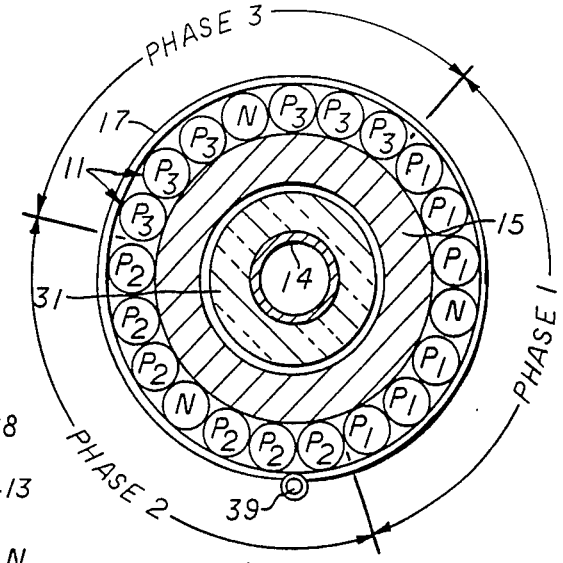
FIG. 3 is a transverse cross section taken along line 3—3 of FIG. 2 showing the upper cable arrangement.

As shown in FIG. 3, the electrical cables 11 comprise eighteen power cables P and three neutral cables N disposed circumferentially about the periphery of the support tube 15. The cables 11 are divided into three sectors with each sector being supplied with a separate phase of three-phase electricity The power cables which carry phase 1 current are designated as P1, phase 2 as P2, and phase 3 as P3. The cables 11 can support their own weight and clamps 17 are spaced intermittently along the support tube length to provide a well bore annulus. The ends of the clamps 17 are held together by a piano type hinge and pin arrangement 39 which surrounds the cables allowing the outside diameter to be free of any projections. The cables 11 are armored to prevent any abrasion of the cable insulation by the clamps.

Figure 4:
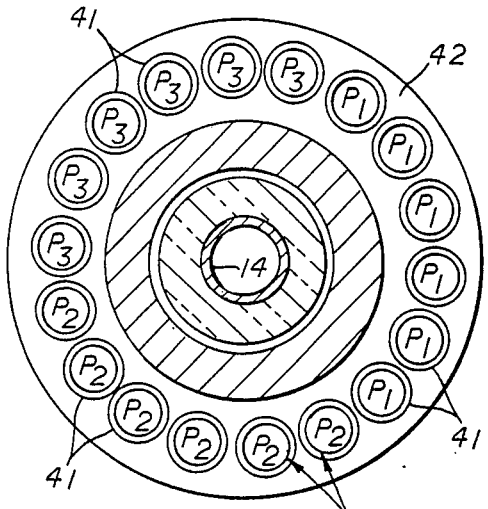
FIG. 4 is a transverse cross section taken along line 4—4 of FIG. 2 showing a lower cable arrangement.

As shown in FIG. 2, a segmented flange 40 extends radially outward from the support tube 15 a distance above the top of the enlarged cylindrical side wall 33 portion. Three neutral cables N are brazed to the flange 40 and the cable circle is increased in the transition region below the flange allowing cable seals 41 to be installed on the top wall 42 of the cylindrical lower portion of the support tube 15. FIG. 4 shows the cable arrangement in this region.

A cylindrical flange 38 extends radially between the interior portion 34 and the cylindrical outer side wall of the support and has circumferentially spaced apertures which receive the down leg of the heating elements 30 to locate the heating elements in their radial positions.

The heating elements 30 are divided into three groups with each group being supplied with a separate phase of three-phase electricity by the power cables (FIGS. 3 and 4). The heating elements 30 are formed in "U" shape so that each heater provides two passes through the boiling region. The return (up) leg of each heating element is grounded to each other by brazing each one to the bottom of the the support tube structure to form the grounded neutral. This arrangement minimizes the number of heaters, as well as permitting the heaters to be grounded (neutral) to the support tube structure. Any neutral current flow travels only a short distance through a jointless section of the structural assembly.

In order to improve the reliability of the high voltage connection between the cable and the heater, one power cable is connected to the down leg of each heating element and the high voltage connection 43 is enclosed in the structure between the top wall 42 and the flange 38. This cable arrangement permits the use of somewhat higher system voltages thereby reducing the current flow and allows the use of smaller cables.

Figure 5:
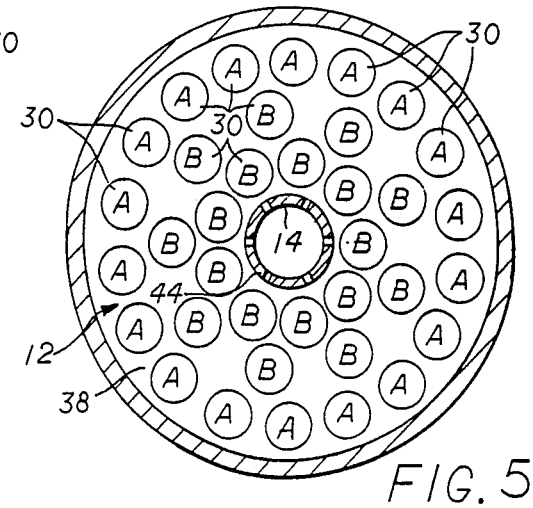
FIG. 5 is a transverse cross section taken along line 5—5 of FIG. 2 showing the arrangement of the heating elements.
Figure 6:
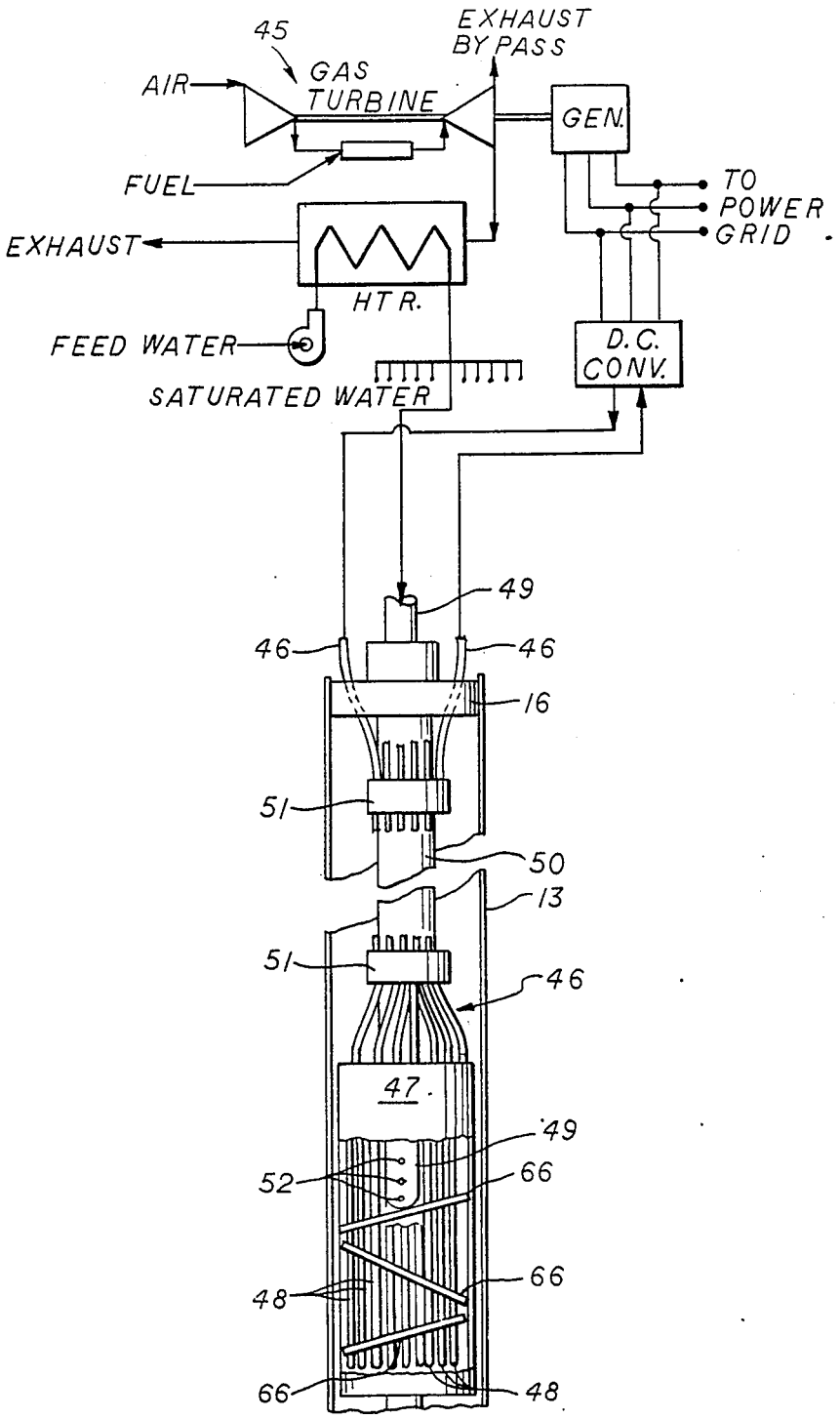
FIG. 6 is a schematic illustration of the above ground components of a preferred thermally-enhanced oil recovery system using direct current.

The heating elements 30 are firmly secured at both the up and down legs. In order to supply some flexibility, the distance between legs is preferably greater than 3 inches. Since the heaters are located in a boiling region, there should not be large temperature differences between the heater legs. The heating element arrangement is shown in FIG. 5. The designation A and B are for down (A) and up (B) legs of the heaters.

FIG. 5 shows in cross section, the heater region where the hot feed water is vaporized. The heating elements 30 have an active length of 36 feet per leg based on a 50 watt/sq. in heat flux and 1000 barrel per day steam injection rate. Each phase of the three-phase electrical power cables is connected to six of the U-shaped heater elements. The flow from the injection tube 14 exits through radial orifices 44 in the tube side wall. These orifices 44 feed sections of the heater bundle where the steam is generated and exits at the bundle bottom to flow downward into the reservoir. A spiral flow and heater guide 67 is supported by the structure 33 to space the heaters radially and to provide a defined flow path.

DESCRIPTION OF THE ALTERNATE (DC) EMBODIMENT

The thermally-enhanced oil recovery system in accordance with the present invention may alternatively be powered by direct current. There is shown schematically in FIG. 6, the above ground portion, and in FIG. 7 the underground portion, of the direct current system. Above-ground turbine-driven electric generators 45 supply electrical power through electrical cables 46 to steam generators within a heater assembly 47 disposed in the well string casing 47 below ground to heat injection fluids. The turbine-driven electric generators 45 are fueled by gas or other clean fuel.

The downhole heater assembly 47 (described in greater detail hereinafter) contains a series of elongated electric heating elements 48 circumferentially disposed about a continuous axially extending injection tube 49. The injection tube 49 preferably has no mechanical joints. The upper end of a hollow support tube 50 is connected to the upper end of the well casing 13 by a flange 16 and the support tube extends downward centrally within the casing terminating in close proximity to the reservoir to be thermally stimulated. The support tube 50 is formed of electrical and thermal insulating material and surrounds the injection tube 49 above the heater assembly 47. The electrical cables 46 are also preferably continuous. The cables 46 may be reeled and attached by conventional means such as clamps 51 to the outside of the support tube 50. The cables can support their own weight and the clamps may be spaced intermittantly along the support tube length to allow circulation in the well bore annulus.

The injection tube 49 is closed at the bottom and contains radial ports 52 so that injection fluid (pressurized hot water) is forced between the heater elements (described hereinafter) and vaporized. This vaporized water then flows downward into a reservoir that is being thermally stimulated.

Figure 7:
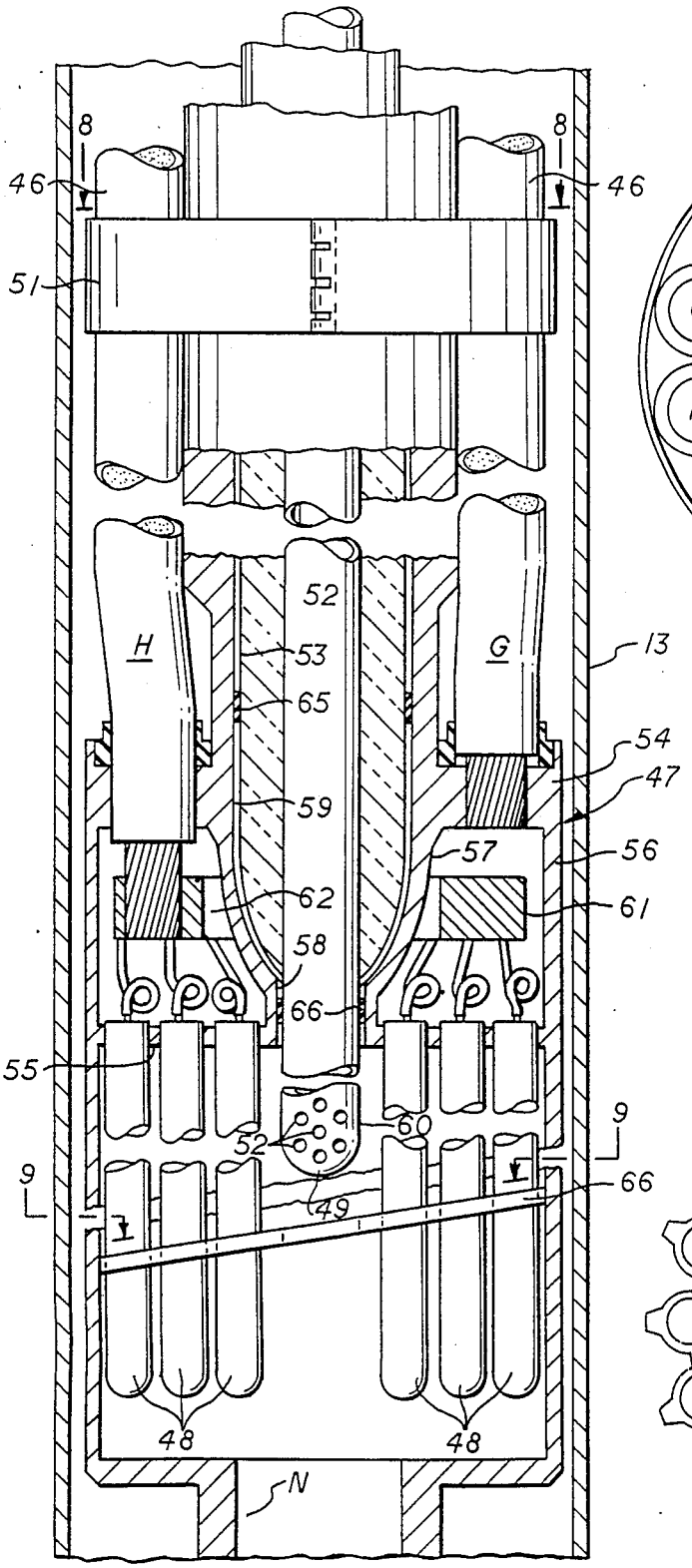
FIG. 7 is a longitudinal cross section of the heater assembly showing the electrical cable and heater regions and the support tube and injection tube regions of the direct current embodiment.
Figure 8:
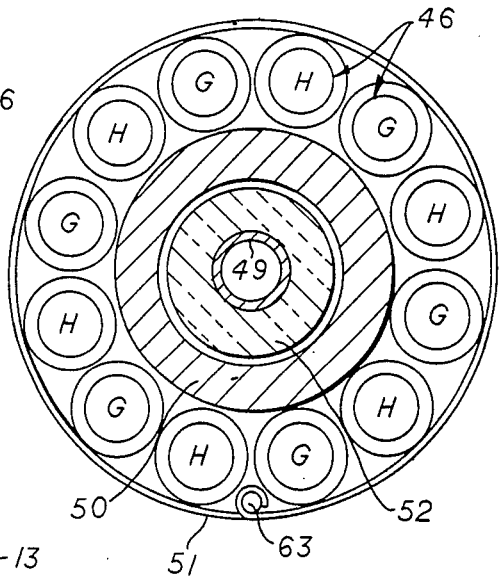
FIG. 8 is a transverse cross section taken along line 8—8 of FIG. 7 showing the upper cable arrangement.
Figure 9:
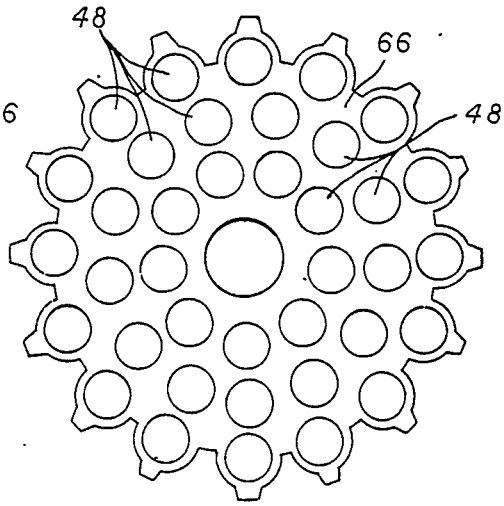
FIG. 9 is a transverse cross section taken along line 9—9 of FIG. 7 showing the arrangement of the heating elements.

Referring now to FIGS. 7, 8, and 9, the downhole heater assembly 47 comprises a series of parallel elongated electric heating elements 48 circumferentially disposed about the axially extending injection tube 49. The injection tube 49 is preferably made of small-diameter titanium alloy tubing and is covered with thermal insulation 52 and an outer sheath 53. Because of its small-diameter, the tube has enough flexibility to be assembled as a single unit. The injection tube 49 is installed in the support tube 50 after it has been inserted into the well bore.

As shown in FIG. 7, the lower end of the support tube 50 extends outwardly to form an enclosed cylindrical chamber having a top wall 54, a bottom wall 55, and a cylindrical outer side wall 56 concentric with, and spaced radially outward from the interior portion 57. The exterior diameter of the outer side wall 56 is smaller than the interior diameter of the well casing 13 to form an annulus between them. The support tube interior portion 57 is provided with a bore 58 at its lower end which is smaller in diameter than the central bore 59. The injection tube 49 has a bare portion 60 which extends downwardly through the bore 58 to terminate in the heater array. The transition between the electrical cable and heater regions and the support tube and injection tube regions occurs within the lower cylindrical chamber of the support tube 50.

A circular plate or bus bar 61 surrounds the interior portion 57 of the support tube 50 between the top all 54 and bottom wall 55. The bus bar 61 has a central bore 62 spaced outward from the support tube interior portion 57 and its outer diameter is spaced inward from the cylindrical side wall 56.

As shown in FIGS. 7 and 8, the electrical cables 46 comprise twelve power cables disposed circumferentially about the periphery of the support tube 50. Alternate cables indicated by G are grounded to the top wall 54 of the support tube 50 and the remaining "hot" cables indicated by H pass through the top wall 54 and are attached to the circular bus bar 61. The cables are grounded and attached by suitable means such as brazing. The cables can support their own weight and clamps 51 are spaced intermittently along the support tube length to provide spacing in the well bore annulus. The ends of the clamps 51 are held together by a piano type hinge and pin arrangement 63 which surrounds the cables allowing the outside diameter to be free of any projections. The cables 46 are armored to prevent any abrasion of the cable insulation by the clamps.

The top ends of the heating elements 48 are brazed in apertures in the bottom wall 55 of the chamber grounding the heating element sheaths to the support tube structure. As shown in FIG. 9, the heating elements 48 are arranged in a series of concentric circles extending radially from the injection tube 49. A series of wire "pigtails" 64 connect the bus bar 61 to the core of each heating element 48. The vertical space between the bus bar 61 and the bottom wall 55 may be filled with a suitable seal or potting material (not shown) for thermal and electrical insulation of the heater connections. Suitable electrical and thermal seals 65 and 66 are provided in the annular space between the exterior of the injection tube 49 and the internal bores 58 and 59 of the support tube 50 above and below the bus bar 61.

FIG. 9 shows the heater region at the circular support plate 66. The heater elements 48 have an active length of 34 feet based on a 50 watt/sq. in. heat flux. The injection tube bare portion 60 extends down into the heater array. The injection tube 49 is closed at the bottom. The flow from the injection tube 49 exits through orifices 52 in the tube side wall. These orifices feed sections of the heater bundle where the steam is generated and exits at the bundle periphery. In this peripheral space, the steam flows downward into the reservoir.

Circular support plates 66 having apertures which receive the heating elements 48 are secured to the heating elements in an angular position relative to vertical axis. The support plates 66 are spaced vertically apart in opposed angles to form a spiral steam flow path. The spiral arrangement prevents flow stagnation regions which could cause excessive heater temperatures. The generated steam exits at the bundle periphery to flow downward into the reservoir.

OPERATION

The above described system provides some of the heat by transporting part of it downhole and the remainder delivered electrically to the reservoir face. The support tube and heater assembly is placed into the well bore casing and secured at the top end to the casing by a flange. The insulated injection tube is fed down into the support tube until the bare portion is adjacent the heater bundle. The appropriate cable and tubing connections are made at the surface to the turbine generator and heating components.

Saturated water is pumped down to the heater assembly. By injecting saturated water at high pressure, approximately 65% of the heat is supplied in this fashion. The energy contained in the hot water increases when the operating pressure increases. For example, a pressure increase from 1000 psia to 2000 psia increases the energy that a pound of saturated water contains by almost 25%. The density of the saturated water at 2000 psia is 7.5 times greater than steam. This higher density of hot water provides two major advantages. The first is the ability to use a smaller pipe to conduct the heat down into the well. The second is the large hydrostatic head that exists because of the high density of the liquid water. At 2500 feet, the hydrostatic head is 675 psi for saturated water at 2000 psia operating pressure. The hydrostatic head allows the use of a lower system pressure when compared to steam, which has little static head pressure.

Since the present invention uses an insulated injection tube of small, constant diameter (such as .1-inch), the pressure drop of the water flowing down the tube is proportional to depth. The pressure drop then provides a linear gradient from the top (highest pressure) to the bottom (lowest pressure). If the total pressure drop were equal to the hydrostatic head (675 psi in our example), then the two pressures would cancel each other at all points down the tube. The tube pressure would then be constant along its entire length and be equal to the initial pressure applied at the well head. When, for other reasons, the operating pressure is higher than the reservoir pressure, an orifice can be used to reduce the pressure at the reservoir face.

In order to supply the remaining heat downhole, electrical power is transmitted to the reservoir face by the electric cables connected to the heating elements to supply the remaining 35% of the heat. While the electric power might be supplied by a utility, a markedly more efficient means is provided by the use of an on-site gas turbine to supply both the hot water from the turbine exhaust and the electricity from an electrical generator driven by the turbine. Gas turbines have a ratio of heat to electricity which satisfactorily matches the requirements of the proposed system using a reasonable operating pressure. The total energy input to the proposed system using a gas turbine is the same as conventional boiler steam flooding systems with both delivering about the same amount of heat to the well head. However, the much smaller downhole heat loss of the present system (factor of 8) makes the system more economical for the deeper reservoirs.

Another dimension is achieved by supplying part or all of the electric power for other uses (cogeneration) while still supplying the thermal heat from the gas turbine exhaust. Cogeneration provides major economic advantages, since the system has the flexibility to supply the power on a demand basis. For example, at 2500 feet, with peaking power rates and 25% cogeneration, the process cost per barrel of oil is half that of conventional systems.

While this invention has been described fully and completely with special emphasis upon a preferred embodiment, it should be understood that within the scope of the appended claims the invention may be practiced otherwise than as specifically described herein.

We claim:

1. A method of stimulating the flow of oil from a reservoir formation traversed by a bore hole, comprising providing an above-ground hydrocarbon powered turbinedriven electric generator to produce electrical power, supplying water in heat exchange relation to the exhaust from said turbine to produce pressurized hot water simultaneously with said power generation, positioning electric heating means in said bore hole between the surface and the point of discharge to said formation and energizing the same by power from said generator, positioning an injection tube in said bore hole adjacent to said heating means, said electric heating means comprising a plurality of electric resistance heaters, completely insulated electrically from injected water and formation fluids positioned circumferentially about said hot water injection tube, said injection tube comprising a small-diameter insulated tube enclosed at the bottom and having orifices in the side wall adjacent to said electric heating means, injecting said pressurized hot water from the surface down the bore hole through said injection tube to expand said water to reservoir pressure, while maintaining a high hydrostatic pressure thereon, and in heat exchange with said electric resistance heaters to convert said water into high pressure steam, said electric resistance heaters being the sole source of heat for vaporizing said pressurized hot water, and directing said high pressure steam from said electric resistance heaters into said oil reservoir to heat the same and stimulate the flow of hydrocarbons therefrom.

2. A method according to claim 1 including supplying a portion of the hydrocarbons produced from said reservoir to said above-ground gas turbine-driven electric generator to power the same.

3. A method according to claim 1 including utilizing a portion of the electrical power cogenerated by said above-ground gas turbine-driven electric generator as a by product to be sold to an electric utility.

4. A method according to claim 1 in which said heating means comprises three electric heaters, and supplying each electric heater with one phase of three-phase alternating electrical current.

5. A method according to claim 1 in which the exterior of each said heater is grounded and direct current is supplied to the interior of each said heater.

6. A system of apparatus for stimulating the flow of oil from a reservoir formation traversed by a bore hole, a well bore extending from the surface to an oil reservoir, an elongated cylindrical support member suspended concentrically within said well bore for supporting a downhole production string.

electric heating means connected to said support member adjacent to said reservoir providing heat to water or steam circulated through said well bore, a gas turbine-driven electric generator positioned at the surface of said well bore for producing electrical power, heat exchange means connected to a source of water and positioned to supply water in heat exchange with the exhaust from said turbine to produce pressurized hot water, injection means positioned centrally within said support member and having a lower portion positioned to conduct said pressurized hot water from the surface to said heating means, said injection means comprising a small-diameter insulated tube enclosed at the bottom and having orifices in the side wall adjacent to said electric heating means and being adapted to expand said water to reservoir pressure and inject same into contact with said heating means to convert the water into high pressure steam, and said electric heating means comprising a plurality of electric resistance heaters, completely insulated electrically from injected water and formation fluids positioned circumferentially about said hot water injection tube, said small-diameter insulated tube being adjacent to said electric resistance heaters and adapted to expand said water to reservoir pressure and inject same into contact with said electric resistance heaters to convert the water into high pressure steam, said electric resistance heaters being the sole source of heat for vaporizing said pressurized hot water, means to direct said high pressure steam from said electric resistance heaters into said oil reservoir to heat the same to stimulate the flow of hydrocarbons therefrom.

7. A system of apparatus according to claim 6 in which said gas turbine-driven electric generator is connected to be fueled at least in part by a portion of the fuel produced from the reservoir being stimulated.

8. A system of apparatus according to claim 6 in which said gas turbine-driven electric generator is connected to supply surplus energy to an electric utility.

9. A system of apparatus according to claim 6 in which said axially extending tubular member comprises a small-diameter titanium alloy tubing covered with thermal insulation and an outer sheath.

10. A system of apparatus according to claim 6 in which said heating means comprises a series of elongated U-shaped electric heating elements circumferentially disposed about said injection means.

11. A system of apparatus according to claim 6 in which said heating means is connected to utilize multiple-phase electrical current for the production of heat.

12. A system of apparatus according to claim 11 in which said generator is a polyphase generator connected in a three-phase, grounded neutral "Y" electrical system, said heating means comprises a series of elongated electric heating elements circumferentially disposed about said injection means and each having one end grounded to said support means, said grounded ends being common and the neutral of the system, said electric generator is connected to said heating elements by a series of insulated electrical cables, said cables and said heating elements being divided into three groups, and each group being supplied with a separate phase of three-phase electricity, three of said cables being neutral and connected to said support member and the remaining cables carrying high voltage each connected to the other end of each said heating element.

13. A system of apparatus according to claim 12 in which said support tube is formed of electrical and thermal insulating material.

14. A system of apparatus according to claim 12 in which said heating means comprises a series of elongated U-shaped electric heating elements.

15. A system of apparatus according to claim 6 in which said generator produces direct current for the production of heat.

16. A system of apparatus according to claim 15 in which said heating means comprises a series of elongated electric heating elements circumferentially disposed about said injection means, a circular bus bar is positioned within said support member surrounding said injection means and insulated from contact with said support member and said injection member, said heating means comprises a series of elongated, sheathed electric heating elements circumferentially disposed about said injection means and the sheaths grounded to said support means, said grounded sheaths ends being common and the neutral of the system.

a plurality of insulated electrical cables connecting said turbine-driven electric generator to said heating means, alternate ones of said cables being neutral and connected to said support member and the remaining cables carrying high voltage each connected to said bus bar, and said bus bar being connected to the core of each said heating element.

17. A system of apparatus according to claim 16 in which said heating elements are arranged in concentric circles extending radially from said injection tube.

18. A system of apparatus according to claim 16 including a series of vertically spaced circular plates received on and secured to said heating elements in opposed angular positions defining a spiral steam flow path.

19. An injection-heater for injecting high-pressure steam into a well formation comprising an elongated axially extending tubular member adapted to be secured on the lower end of a conduit supported in a well bore, said tubular member being enclosed at its bottom end and having a series of apertures in its side wall adjacent thereto, heating means comprising a plurality of elongated electric heating elements circumferentially disposed about said tubular member bottom end adjacent to said apertures, said electric heating means comprising a plurality of electric resistance heaters, completely insulated electrically from injected water and formation fluids positioned circumferentially about said tubular member, (said tubular member being adapted to receive water conducted from the surface through said conduit and to expand said water to well formation pressure and inject same into contact with said heating means to convert the water into high pressure steam, and)

said tubular member being adjacent to said electric resistance heaters and adapted to receive water conducted from the surface through said conduit and to expand said water to reservoir pressure and inject same into contact with said electric resistance heaters to convert the water into high pressure steam, said electric resistance heaters being the sole source of heat for vaporizing said pressurized hot water, and means to direct said high pressure steam from said (heating means) electric resistance heaters into said well formation to heat the same to stimulate the flow of hydrocarbons therefrom.

20. An injector-heater according to claim 19 in which said axially extending tubular member comprises a small-diameter titanium alloy tubing covered with thermal insulation and an outer sheath.

21. An injector-heater according to claim 20 in which said heating means comprises a series of elongated U-shaped electric heating elements circumferentially disposed about said tubular member.

22. An injector-heater according to claim 21 in which a circular bus bar is positioned within said support member surrounding said injection means and insulated from contact with said support member and said injection member, said elongated electric heating elements being sheathed and the sheaths grounded to the support means therefor, said grounded sheaths' ends being common and the neutral of the system, said heating elements being adapted to be connected to a plurality of insulated electrical cables connecting the same to a surface-mounted electric generator, alternate ones of said cables being neutral and connected to the support for said tubular member and the remaining cables carrying high voltage each connected to said bus bar, and said bus bar being connected to the core of each said heating element.

23. An injector-heater according to claim 22 in which said heating elements are arranged in concentric circles extending radially from said injection tube.

24. An injector-heater according to claim 23 including a series of vertically spaced circular plates received on and secured to said heating elements in opposed angular positions defining a spiral steam flow path.

* * * * *